US006622957B1

(12) United States Patent
Fleming

(10) Patent No.: US 6,622,957 B1
(45) Date of Patent: Sep. 23, 2003

(54) SINGLE OPERATOR VARIABLE SIZE HOSE WINDER

(75) Inventor: Joseph D. Fleming, San Dimas, CA (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 22 days.

(21) Appl. No.: 10/104,196

(22) Filed: Mar. 22, 2002

(51) Int. Cl.[7] ..... B65H 75/34

(52) U.S. Cl. ..... 242/532.6; 242/533; 242/533.7; 242/546; 242/548

(58) Field of Search ..... 242/532.6, 533, 242/533.7, 546, 548

(56) References Cited

U.S. PATENT DOCUMENTS

| | | | | | |
|---|---|---|---|---|---|
| 1,089,265 | A | | 3/1914 | Ridley | |
| 2,396,451 | A | | 3/1946 | Warkentin | 242/86 |
| 2,869,800 | A | | 1/1959 | Eden | 242/86 |
| 2,933,262 | A | * | 4/1960 | Fish | 242/532.6 |
| 2,960,279 | A | | 11/1960 | Little | 242/86.1 |
| 3,124,321 | A | | 3/1964 | Rylott et al. | 242/86.2 |
| 3,254,862 | A | * | 6/1966 | Bates et al. | 242/471 |
| 3,946,964 | A | | 3/1976 | Zinser | 242/86 |
| 4,057,198 | A | * | 11/1977 | Whitfield | 242/532.6 |
| 4,117,991 | A | * | 10/1978 | Johnson | 242/532.6 |
| 4,198,010 | A | | 4/1980 | Knapp | 242/86.2 |
| 4,265,414 | A | * | 5/1981 | Spradling | 242/532.6 |
| 4,266,740 | A | * | 5/1981 | Ramos et al. | 242/532.6 |
| 4,280,672 | A | * | 7/1981 | Santos et al. | 242/534.2 |
| 4,592,519 | A | * | 6/1986 | Peacock | 242/532.6 |
| 5,033,690 | A | * | 7/1991 | McIver | 242/532.6 |
| 5,205,509 | A | | 4/1993 | Noggle | 242/86 |
| 5,505,404 | A | * | 4/1996 | Dubreuil | 242/532.6 |
| 5,566,901 | A | | 10/1996 | Wilder | 242/532.6 |
| 6,027,066 | A | * | 2/2000 | Street | 242/532.5 |
| 6,206,317 | B1 | * | 3/2001 | Harvestine | 242/395 |
| 6,332,586 | B1 | * | 12/2001 | Risa et al. | 242/530.2 |

FOREIGN PATENT DOCUMENTS

| | | | | |
|---|---|---|---|---|
| JP | 06171834 A | * | 6/1994 | B65H/75/40 |
| JP | 06171835 A | * | 6/1994 | B65H/75/40 |

* cited by examiner

*Primary Examiner*—Kathy Matecki
*Assistant Examiner*—Sang Kim
(74) *Attorney, Agent, or Firm*—John D. Fado; Janet I. Stockhausen

(57) ABSTRACT

The present inventive subject matter relates to a hose winder for coiling hose, particularly firefighting hose, comprising a fixed back plate with a rotating hub containing a plurality of tines and an inner plate having a plurality of holes through which the tines protrude. The hose winder produces consistently circular coiled hose and the fire hose can be pushed away from the back plate by the inner plate, via foot pedal, moving the fire hose away from the back plate for easy removal of the fire hose by a single operator.

11 Claims, 2 Drawing Sheets

SINGLE OPERATOR VARIABLE SIZE HOSE WINDER

FIELD OF THE INVENTION

The present inventive subject matter relates to equipment for handling fire hose or the like and more particularly to a new and improved variable size hose winding apparatus especially adapted to coil fire hose and to facilitate removal by a single operator.

DESCRIPTION OF THE PRIOR ART

Many hose roller designs exist. Existing designs can be divided between those that roll the hose up and intend in-place storage of rolled hose, and those that intend for the removal and storage of the rolled hose separate from the hose roller.

Of the prior art hose rollers intending the removal and storage of the wound hose, there are none that satisfy the combined criteria of easy removal, ability to roll various sizes and styles of hose, one-person efficient operation, minimized risk of uncoiling, and easily-stored, round formation of the wound, coiled fire hose.

In general, a problem with these prior art hose winders is that they are not suitable for winding large diameter or relatively heavy, double jacket hoses. In addition, the prior art winders may be difficult for one man to operate and generally lack the portability to be utilized in field operations.

U.S. Pat. No. 5,556,901 discloses a hose winding method and device for use in connection with collapsible hose, such as fire hose. A self-supporting, stand-alone support structure is provided with an elongated crankshaft extending the width thereof. One end of the crankshaft includes a yoke for receipt of a hose couple, and the other end of the crankshaft includes a handle for turning the yoke such that the hose is wound about the yoke. A hose guide is provided upstream of the yoke and includes a stationary hose engagement portion which frictionally engages the hose to force water out of the hose and also to flatten the hose. The hose winder configuration allows for hoses to be wound at a variety of locations and on a variety of terrains. U.S. Pat. No. 5,556,901 is operable by a single person; however, without a guide or back plate for the hose to wind against, it fails to prevent uncoiling.

U.S. Pat. No. 5,205,509 describes an apparatus arranged for selective securement to a receiver socket, wherein the apparatus includes a generally "S" shaped support beam mounting a crank handle at a forward end thereof to rotatably secure a fire hose thereabout. The crank handle includes an extension leg member secured to the crank handle, including an "L" shaped lock leg mounted to the extension leg to secure the hose thereto in a winding operation. The invention further includes a hose mounting bracket, wherein the extension leg is removable relative to the crank arm and securable to the mounting bracket to permit securing and storage of the hose for ease of transport thereof. U.S. Pat. No. 5,205,509 addresses the uncoiling issue; however, it does this through cumbersome spring-loaded arms that must stay with the coiled hose or be removed, in an additional operation requiring additional labor resources.

U.S. Pat. No. 3,946,964 describes an apparatus for rolling a collapsed hose into a roll which includes a frame having a pair of spaced-apart side rails and a crank for rolling the hose between the side rails. One side rail includes a keyed opening which receives the shaft of the crank and an axially extending spaced-apart pin on the shaft when the shaft is in a keyed orientation relative to the opening. The shaft of the crank is borne by both side rails and the axially extending pin cooperates with the shaft to engage a collapsed hose, which is wound about the shaft and pin by cranking a handle portion on the shaft outside the side rails. When the hose is rolled, the shaft and pin are brought into keyed alignment with the opening in one of the side walls and the crank is removed, permitting the rolled hose to be lifted from the frame. U.S. Pat. No. 3,946,964 addresses the uncoiling issue with the use of a side bar on either side of the hose coil being wound. However, this method limits its usefulness to one particular hose size and requires someone to physically pull the coiled hose from between the two side rails.

U.S. Pat. No. 2,960,279 describes a hose roller comprising a frame, including a plate with a planar surface and a wheel rotatably mounted on the frame. The wheel includes a circular disk disposed in a circular opening in the plate with the disk having a face which is co-planar with the planar surface. A stud is mounted on the face of the disk adjacent to the periphery of the disk and a hub is retractably mounted on the axis of rotation of the wheel. The hub is movable between a first projected position and a second retracted position by means of a crank arm. U.S. Pat. No. 2,960,279 while providing a back plate upon which to wind the hose and keep it from uncoiling, ultimately fails to prevent uncoiling because its hub can only be removed, via lever, operated from the opposite side of the apparatus as the winding occurs. This requires an additional person to perform hub removal; otherwise the coiled hose will tend to fall and unwind. Additionally, the pressure from winding makes manual removal of the hub difficult. Finally, the single tine design will often produce egg-shaped coils, rather than the desired and easier to store round-shaped coils.

U.S. Pat. No. 2,396,451 describes a hose reel which has a rectangular frame upon which is mounted a shaft which is rotated by a handle on one end of the shaft. A first disc is attached to the shaft on the end opposite the handle. A plate and a pin are mounted on the face of the first disc. Pivoted brackets secure a retainer disc to the first disc. The shaft is secured to the frame by bearings. The hose is fastened around the pin and then wrapped over the plate. As the shaft is rotated, the hose is reeled between the first disc and the retainer disc into a flat, doughnut-like roll.

U.S. Pat. No. 1,089,285 describes a hose reel comprising a frame having a guide wall and a winding shaft arranged with one end extending through the wall and provided with an attaching device for engaging one end of a hose. The device also comprises means to turn the winding shaft with its attaching device and a forming element mounted for movement to a position parallel with and spaced from the guiding wall and also adapted to be opened outwardly from the wall to permit the removal of a coiled hose from the attaching device.

U.S. Pat. Nos. 1,089,265 and 2,396,451 provide for the positive guiding of the hose while being wound with a hinged door that covers the exposed side of the hose during winding. However, this process requires an additional step both before and after winding and must be separately adjusted for each size of hose being wound.

U.S. Pat. No. 4,198,010 describes an apparatus for winding canvas fire hose into a compact coil comprising a rotatably mounted winding disc for coiling the hose, an electric drive assembly for rotating the winding disc, and a mobile base with an offset leg arrangement for supporting the winding disc and drive assembly. The winding disc is mounted for rotation about a generally horizontal rotational axis and is provided with two support members in the form of a flat support plate and an offset guide pin for supporting a coupling end of the hose while the hose is coiled around the coupling by rotation of the disc.

U.S. Pat. No. 3,124,321 describes an apparatus for winding a fire hose having interlocking coupling members at opposite ends comprising a pair of spaced tines radially spaced for rotating one of the coupling members about an axis extending laterally through substantially its center of gravity and being arranged to align the center of gravity of the coupling member with the axis thereby being dynamically balanced upon rotation thereof. The apparatus further comprises a means for aligning the first edge of the hose radially from the axis as the hose is being wound to facilitate the winding of the hose upon itself.

U.S. Pat. Nos. 4,198,010 and 3,124,321 each provide a back plate for guiding the wound hose as well as motorized operation, but do not provide a means of removing a compressed hose from the tines nor does it ensure the formation of a circular shaped coil after winding.

U.S. Pat. No. 2,869,800 describes a hose winding device comprising a frame, a rotatable winding drum mounted on the frame and a means for rotating the drum. The drum comprises a pair of axially aligned shafts one of which is engaged by the rotating means, a pair of spaced confronting disks mounted rigidly one on the inner end of each of the shafts, with one of the shafts being slidable axially inwardly toward and outwardly from the inner end of the other shaft whereby the disks may be separated laterally into open roll-removing position. The invention further comprises means for preventing the outward movement of the axially slidable shaft and hose engaging means disposed on the confronting sides of the disks, longitudinal adjustment means on the slidable shaft engageable by the means for preventing the outward movement of the shaft, thereby allowing of varying the inward or closed position of the slidable shaft and the resulting spacing between the pair of confronting disks. U.S. Pat. No. 2,869,800 provides a two-sided bobbin for positive winding of the hose; however, this apparatus again requires separate adjustment for each size hose being wound and requires a disassembly of the apparatus to remove the wound hose.

SUMMARY OF THE INVENTION

Current designs for fire hose winders have several distinct disadvantages to the fire-fighting community. The requirement of several spools on which variable size fire hoses are wound creates inefficiency and difficulty in consecutively winding different size hoses. In addition, these winders create difficulty in removal of a wound hose from the winding apparatus due to hose compression on the center hub. This difficulty results often results in multiple personnel to effectively remove the hose from the winder, creating a greater risk of the hose becoming uncoiled prior to storage. The current invention avoids these problems. It creates a hose winder that can be efficiently operated by one firefighter, thereby saving both time and manpower at a critical and dangerous site. Thus, other firefighters can be devoted to the task of firefighting rather than handling fire hose.

Thus, there is currently a need for a fire hose winder the novel features of which help produce a circular, round, easily stored fire hose roll and can roll various sizes and styles of hose with minimized risk of uncoiling.

There is also a need for a fire hose winder in which the operation is efficient, thus permitting operation by a single operator and facilitating easy removal of wound, coiled hose.

There is yet a further need for a hose winder, a hose winder in particular, that does not require additional, consumable spools upon which the hose is wound.

The present inventive subject matter is directed to a variable size fire hose winder apparatus comprising a base and a fixed back plate being adapted to be attached to the base. The inventive subject matter also comprises a rotating means, with the rotating means having a plurality of removably attached tines supporting winding of a fire hose. The rotating means is attached to the back plate. The inventive fire hose winder also includes an inner plate having a front side and a rear side with the front side being adapted to receive a coupling of the fire hose. The inner plate also has a plurality of holes through which the tines protrude and is adapted to slidably engage the tines, while being disposed between the back plate and the fire hose. A pushing means is included in the inventive subject matter, with the pushing means engaging the rear side of the inner plate and being adapted to be controlled by a single operator; wherein after the operator completes a winding operation, the operator actuates the pushing means, pushing the rear side of the inner plate along the tines, thereby allowing the wound fire hose to be removed intact.

It is also a feature and advantage of the inventive subject matter to provide for a fire hose winder apparatus with the ability to roll various sizes and styles of hose into a circular, easily stored hose roll with minimized risk of uncoiling of the roll.

It is yet another feature and advantage of the inventive subject matter to provide for a fire hose winder apparatus that provides efficient one-man operation and which facilitates easy removal of the wound, coiled hose, through the use of the foot operated hub.

The foregoing and other features and advantages will become further apparent from the following detailed description of the presently preferred embodiments, when read in conjunction with reference to the accompanying drawings. It should be understood that the detailed description is illustrative rather than limitative, the scope of the present invention being defined by the appended claims and equivalents thereof.

DETAILED DESCRIPTION OF THE PREFERRED EMBODIMENTS

In accordance with the present invention, there is generally provided a variable size fire hose winder apparatus comprising a base and a fixed back plate being adapted to be attached to the base. The inventive subject matter also comprises a rotating means with the means having a plurality of removably attached tines supporting winding of a fire hose with the rotating means being attached to the back plate. The inventive fire hose winder also includes an inner plate having a front side and a rear side with the front side being adapted to receive a coupling of the fire hose. The inner plate also has a plurality of holes through which the tines protrude and is adapted to slidably engage the tines, while being disposed between the back plate and the fire hose. A pushing means is included with the pushing means engaging the rear side of the inner plate and being adapted to be controlled by a single operator, wherein after the operator completes a winding operation, the operator actuates the pushing means, pushing the rear side of the inner plate along the tines, thereby allowing the wound fire hose to be removed intact.

Figure 1:
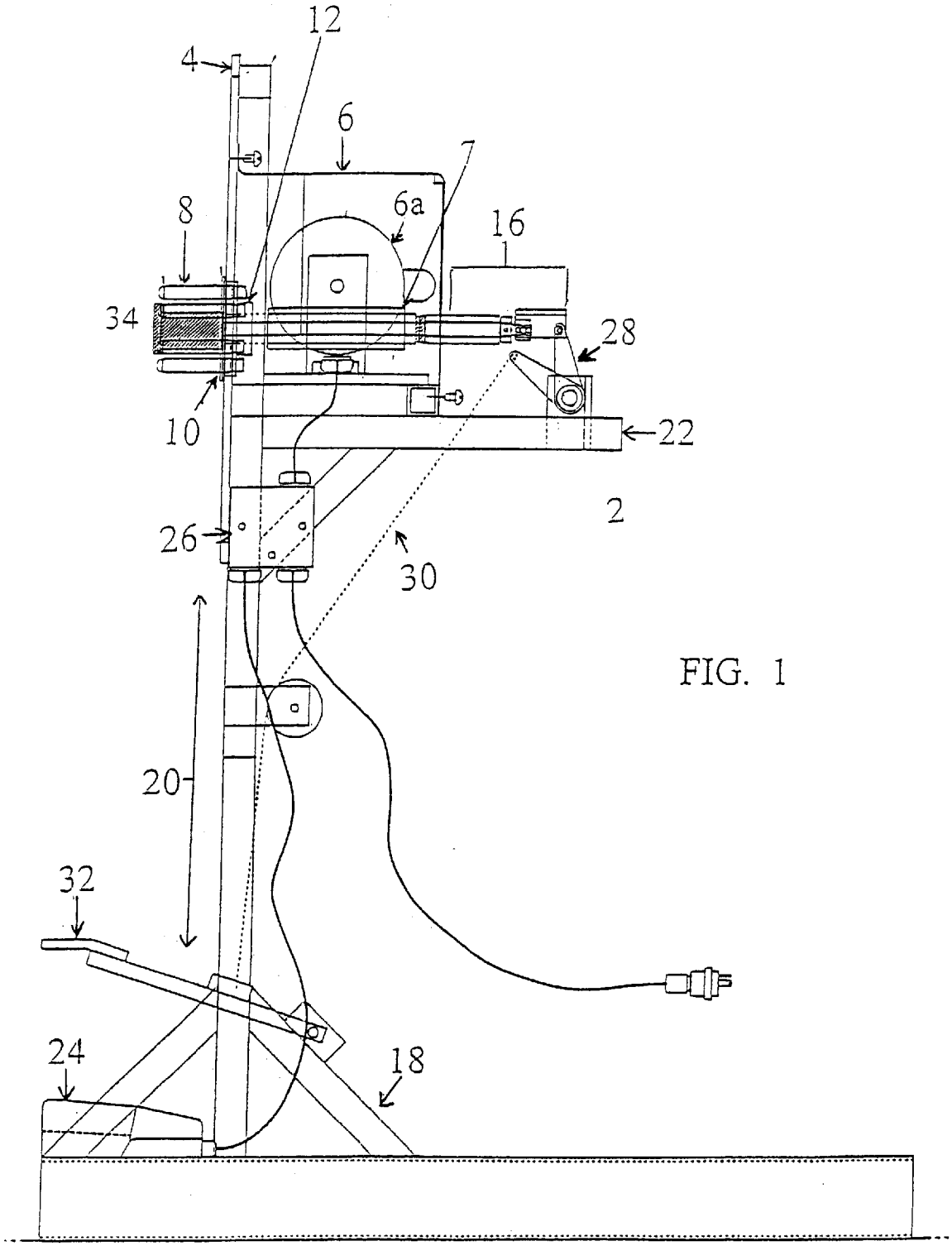
FIG. 1 is a side view of the single operator variable size hose winder.
Figure 2:
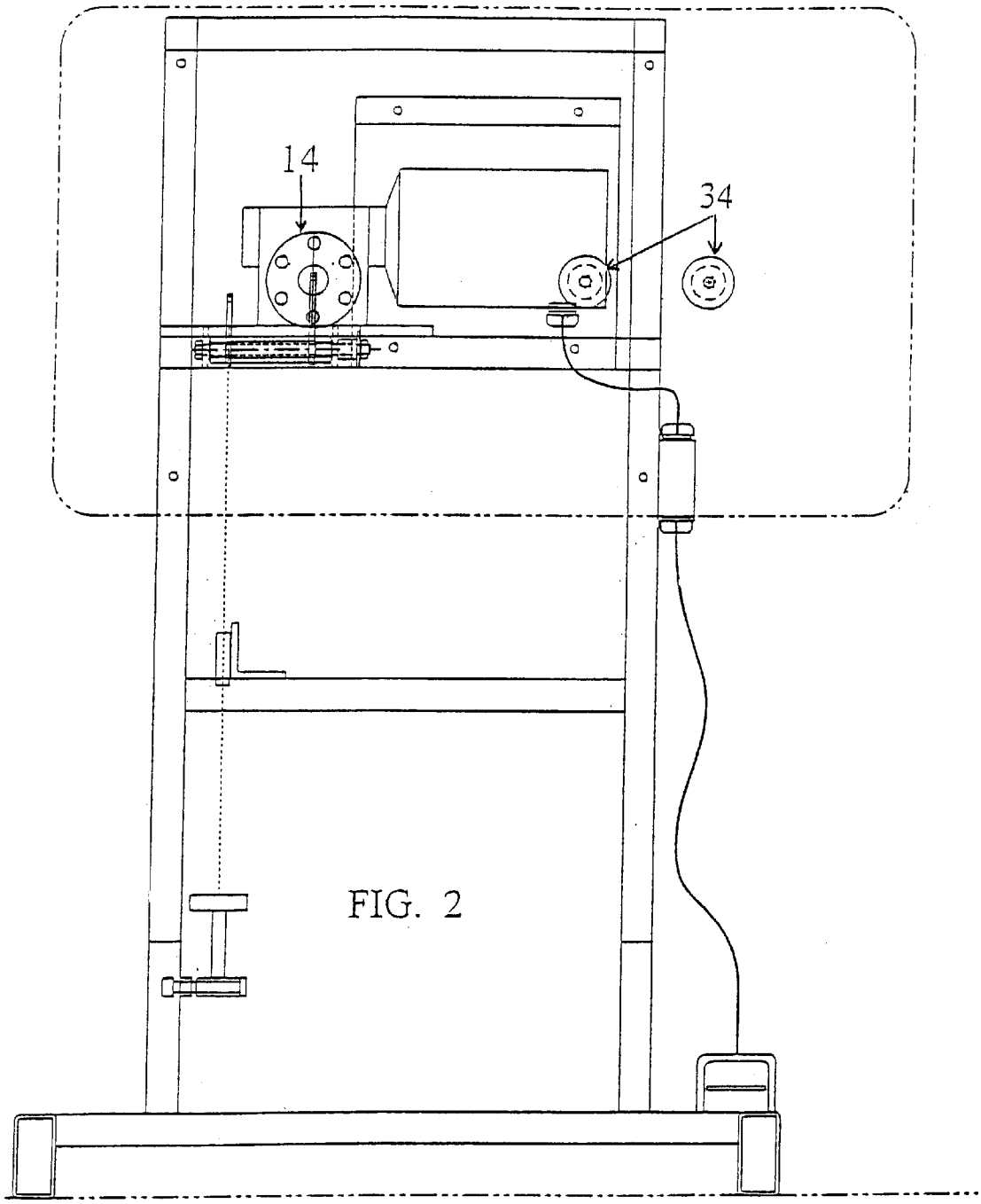
FIG. 2 is a front view of the single operator variable size hose winder.

Referring now to FIGS. 1 and 2, a first embodiment of the inventive fire hose winder comprises a base 2 and a fixed back plate 4 being adapted to be attached to base 2. The inventive subject matter also comprises a rotating means 6 having a plurality of removably attached tines 8 at a hub 12 supporting the winding of a fire hose with rotating means 6 being attached to back plate 4. Also included in the inventive hose winder is an inner plate 10 having a front side and a rear side, the front side of inner plate 10 along with hub 12 being adapted to receive a coupling of the fire hose and inner plate 10 having a plurality of holes 14 (shown in FIG. 2) through which tines 8 protrude, inner plate 10 being adapted to slidably engage tines 8, and inner plate 10 being disposed between back plate 4 and the fire hose (not shown). A pushing means 16 is included engaging the rear side of inner plate 10 and being adapted to be controlled by a single operator, such that after the operator completes a winding operation, the operator actuates pushing means 16, pushing the rear side of inner plate 10 along tines 8, thereby allowing the wound fire hose to be removed intact by the operator.

In a first embodiment of the hose winder apparatus, base 2 is composed of angled supports 18 which attach to a vertical support, both of which may be composed of 3/16" all square steel tubing. A horizontal support 22 supports fixed back plate 4, rotating means 6, tines 8, inner plate 10, and pushing means 16. It will be understood by those of skill in the art that many configurations of bases with varying material compositions having appropriate mechanical strength and durability are possible and all such embodiments are within the spirit of the inventive subject matter.

Preferably, fixed back plate 4 is composed of aluminum and may be attached by screws to the cover of the rotation means 6. However, fixed back plate 4 may be composed of without limitation any durable material that will not splinter and will support the attached equipment load. The center of gravity and the possibility of tip-over should be considered, however. Rotation means 6 comprises a motor and speed reducer combination 6*a* which powers a main shaft 7 connected to hub 12 having a plurality of holes to accept a plurality of tines 8 and disposed adjacent to rear of inner plate 10. In a preferred embodiment, motor and speed reducer 6*a* are a National Electrical Manufacturer's Association (Nema), C-56 ¼ HP, 110V, (a standard motor frame available from various manufacturers) Grainger #2K648 type and a Winsmith model 920MDSN (speed reducer), Grainger #3JH75, respectively, and main shaft and hub 12 are composed of 1018 steel alloy and tines 8 are composed of 303 Cres corrosion resistant steel. The motor is powered by electric power and is provided with a power cord. In an alternative embodiment, the motor may be powered by gas or other means. As will be apparent to those of skill in the motor arts any suitable substitute engine makes or components and materials are well within the scope of the inventive subject matter.

Motor/speed reducer combination 6*a* of rotation means 6 is actuated by a single operator through the use of a foot switch 24 which acts as an on-off switch for the electric motor embodiment and is wired to an electrical box 26 which is then wired to motor/speed reducer combination 6*a*. In an alternative embodiment, gas-powered motor is actuated by a foot switch 24 which then acts as gas throttle rather than as an on-off switch. Inner plate 10 slidably engages tines 8 and is disposed adjacent hub 12.

Pushing means 16 is located to the rear of motor 6a and comprises a series of mechanical components which push forward on the inner plate 10. A pushrod assembly penetrates the rear of the hollow portion of motor/speed reducer combination 6*a* and hub 12 and makes pushing contact with inner plate 10. The pushrod assembly, comprises a bellows, spring, pushrod, collar, flange, thruster and clevis combination that engages inner plate 10. Main shaft 7 is hollow and the pushrod assembly runs through main shaft 7. The pushrod is pushed forward by the thruster at the rear end. The thruster contains a bearing which is preferably made of bronze, and in which the pushrod rotates freely.

A link rod assembly 28 is rotatably attached to the spring, pushrod, flange and clevis combination at the clevis and provides a forward pushing motion to the assembly upon actuation by an operator. Linkrod assembly 28 is actuated by a cable assembly 30 in mechanical connection with foot pedal subassembly 32 which is controlled by the operator. In an alternative embodiment, linkrod assembly 28 may be actuated by electric or gas power means. It will be apparent to those of skill in the art that many variations of such pushing mechanisms are possible and all are within the scope of the inventive subject matter.

In another embodiment, the hub design comprises a six tine design. In this embodiment, hub 12 does not have a center shaft allowing any fire hose coupling size to be placed in the hub center. The hub style is large enough to accommodate the largest of hose couplings while still maintaining a narrow enough gap to hold and wind the smallest hoses. Consequently, round fire hose coils are consistently obtained that have minimized risk of uncoiling. The inventive fire hose winder can accommodate larger size couplings and fire hose by providing the operator with the capability to remove an appropriate number of tines 8. Moreover, the diameter of hub 12 could also be increased to support very large hose sizes.

Thus, the hose winder of the present inventive subject matter allows for adjustments in order to accommodate varying sizes of hose diameter. It is contemplated that hose diameters of 3 inches may be wound by the present inventive hose winder.

In yet another embodiment, two guide rollers 34 are provided as shown in FIG. 2. Guide rollers 34 help flatten and orient the hose before it gets coiled during the winding operation.

Winding Operations

During a winding operation, inner plate 10 is positioned along tines 8. A fire hose (not shown) is fed through guide rollers 34 with hose couple firmly engaging the inside diameter of tines 8. The operator depresses foot switch 24 to activate rotation means 6 which rotates tines 8. The fire hose winds around tines 8 with the hose couple secure in the inside diameter of tines 8. When winding operations are complete and a round, tightly wound fire hose roll is obtained, the operator depresses foot pedal subassembly 32 which actuates pushing means 16, pushing the fire hose towards the operator and allowing the fire hose roll to be removed intact.

The inventive subject matter being thus described, it will be obvious that the same may be varied in many ways. Such variations are not to be regarded as a departure from the spirit and scope of the inventive subject matter, and all such modifications are intended to be within the scope of the following claims.

I claim:

1. A variable size hose winder apparatus comprising:

a base;

a fixed back plate being adapted to be attached to said base;

a rotating means, said means having a plurality of removably attached tines supporting winding of a fire hose, said rotating means being removably attached to said back plate;

an inner plate having a front side and a rear side, said front side being adapted to receive a coupling of said fire hose, said inner plate having a plurality of holes through which said tines protrude, said inner plate being adapted to slidably engage said tines, and said inner plate being disposed between said back plate and said fire hose; and pushing means, said pushing means engaging said rear side of said inner plate and being adapted to be controlled by a single operator, wherein after said operator completes a winding operation, said operator actuates said pushing means, pushing said rear side of said inner plate along said tines, thereby allowing the wound fire hose to be removed intact.

2. The hose winder of claim 1, wherein said rotating means is a motorized rotating hub.

3. The hose winder of claim 2, wherein said rotating hub is gas powered or electric.

4. The hose winder of claim 2, wherein said rotating hub is manually actuated by operation of a foot pedal by an operator.

5. The hose winder of claim 2, wherein said hub is without a center shaft.

6. The hose winder of claim 1, wherein said pushing means comprises a push rod assembly disposed through a hollow main shaft and engages said inner plate.

7. The hose winder of claim 1, wherein said hose winder can wind up fire hose up to 3 inches in diameter.

8. The hose winder of claim 1, wherein said plurality of tines are positioned along the periphery of said rotating means.

9. The hose winder of claim 8, wherein said rotating means has six tines.

10. The hose winder of claim 1, wherein two guide rollers are removably attached to said back plate.

11. The hose winder of claim 1, wherein said pushing means is mechanically actuated or power assisted.

* * * * *